US007087104B2

(12) United States Patent
Choi et al.

(10) Patent No.: US 7,087,104 B2
(45) Date of Patent: Aug. 8, 2006

(54) PREPARATION OF ELECTROLESS DEPOSITION SOLUTIONS

(75) Inventors: Hok-Kin Choi, San Jose, CA (US); Vani Thirumala, San Jose, CA (US); Valery Dubin, Portland, OR (US); Chin-chang Cheng, Portland, OR (US); Ting Zhong, Tigard, OR (US)

(73) Assignee: Intel Corporation, Santa Clara, CA (US)

( * ) Notice: Subject to any disclaimer, the term of this patent is extended or adjusted under 35 U.S.C. 154(b) by 62 days.

(21) Appl. No.: 10/609,443

(22) Filed: Jun. 26, 2003

(65) Prior Publication Data

US 2004/0265501 A1 Dec. 30, 2004

(51) Int. Cl.
*C23C 18/31* (2006.01)
*B05D 1/18* (2006.01)

(52) U.S. Cl. ..... 106/1.22; 106/1.25; 106/1.27; 427/443.1; 427/444

(58) Field of Classification Search ..... 106/1.22, 106/1.25, 1.27; 427/443.1, 444
See application file for complete search history.

(56) References Cited

U.S. PATENT DOCUMENTS

| | | | | |
|---|---|---|---|---|
| 3,776,740 | A * | 12/1973 | Sivertz et al. | 106/1.05 |
| 4,005,229 | A * | 1/1977 | Miller et al. | 427/304 |
| 4,187,198 | A * | 2/1980 | Zeblisky | 106/1.11 |
| 4,574,094 | A | 3/1986 | DeLuca et al. | 205/126 |
| 4,574,095 | A | 3/1986 | Baum et al. | 427/584 |
| 4,780,342 | A * | 10/1988 | LeBlanc, Jr. | 427/443.1 |
| 4,789,648 | A | 12/1988 | Chow et al. | 438/633 |
| 4,894,260 | A | 1/1990 | Kumasaka et al. | 427/241 |
| 4,985,750 | A | 1/1991 | Hoshino | 257/751 |
| 5,151,168 | A | 9/1992 | Gilton et al. | 205/123 |
| 5,169,680 | A | 12/1992 | Ting et al. | 438/629 |
| 5,183,795 | A | 2/1993 | Ting et al. | 438/618 |
| 5,240,497 | A | 8/1993 | Shacham et al. | 106/1.26 |
| 5,612,254 | A | 3/1997 | Mu et al. | 438/634 |
| 5,619,072 | A | 4/1997 | Mehta | |
| 5,674,787 | A | 10/1997 | Zhao et al. | |
| 5,695,810 | A | 12/1997 | Dubin et al. | 427/96 |
| 5,739,579 | A | 4/1998 | Chiang et al. | 257/635 |
| 5,824,599 | A | 10/1998 | Shacham-Diamand et al. | 438/678 |
| 5,830,805 | A | 11/1998 | Shacham-Diamand et al. | 438/678 |

(Continued)

FOREIGN PATENT DOCUMENTS

EP 1022770 A2 7/2000

(Continued)

OTHER PUBLICATIONS

"Thick Selective Electroless-Plated Cobalt-Nickel Alloy Contacts to CoSi2"; G.E. Georgiou, F. et al. J. Electrochem. Soc., vol. 138, No. 7, Jul. 1991, pp. 2061-2069. © The Electrochemical Society, Inc.

(Continued)

*Primary Examiner*—Helene Klemanski
(74) *Attorney, Agent, or Firm*—Blakely, Sokoloff, Taylor & Zafman LLP

(57) ABSTRACT

A system and method for storing a solution containing a subset of a group consisting of a metal ion, a complexing agent, an ammonium salt, and a strong base and then nearer to a time of use in an electroless deposition process, using the solution to form an electroless deposition solution containing the entire group. In one embodiment of the invention, the metal ion includes a cobalt ion, the complexing agent includes citric acid, the ammonium salt includes ammonium chloride, and the strong base includes tetramethylammonium hydroxide.

23 Claims, 3 Drawing Sheets

U.S. PATENT DOCUMENTS

| | | | | |
|---|---|---|---|---|
| 5,891,513 | A | 4/1999 | Dubin et al. | 438/633 |
| 6,048,445 | A | 4/2000 | Brain | 205/118 |
| 6,100,184 | A | 8/2000 | Zhao et al. | |
| 6,153,935 | A | 11/2000 | Edelstein et al. | 257/773 |
| 6,169,024 | B1 | 1/2001 | Hussein | 438/627 |
| 6,174,812 | B1 | 1/2001 | Hsiung et al. | 438/687 |
| 6,197,364 | B1 * | 3/2001 | Paunovic et al. | 427/132 |
| 6,197,688 | B1 | 3/2001 | Simpson | 438/678 |
| 6,207,556 | B1 | 3/2001 | Hsu | |
| 6,258,707 | B1 | 7/2001 | Uzoh | 438/618 |
| 6,310,019 | B1 | 10/2001 | Kakizawa et al. | |
| 6,316,359 | B1 | 11/2001 | Simpson | 438/678 |
| 6,342,733 | B1 | 1/2002 | Hu et al. | |
| 6,350,687 | B1 | 2/2002 | Avazino et al. | 438/687 |
| 6,358,832 | B1 | 3/2002 | Edelstein et al. | 438/612 |
| 6,359,328 | B1 | 3/2002 | Dubin | 257/622 |
| 6,441,492 | B1 | 8/2002 | Cunningham | |
| 6,471,845 | B1 * | 10/2002 | Dukovic et al. | 205/81 |
| 6,537,902 | B1 | 3/2003 | Orita | |
| 6,605,874 | B1 | 8/2003 | Leu et al. | |
| 6,613,664 | B1 | 9/2003 | Barth et al. | |
| 6,680,540 | B1 | 1/2004 | Nakano et al. | |
| 6,709,874 | B1 | 3/2004 | Ning | |
| 6,878,632 | B1 | 4/2005 | Nogami et al. | |
| 2001/0030366 | A1 * | 10/2001 | Nakano et al. | 257/758 |
| 2001/0055873 | A1 | 12/2001 | Watanabe et al. | |
| 2002/0027261 | A1 | 3/2002 | Besser et al. | |
| 2002/0079589 | A1 | 6/2002 | Gayet et al. | |
| 2003/0113576 | A1 * | 6/2003 | Chebiam et al. | 428/670 |
| 2003/0148618 | A1 | 8/2003 | Parikh | |
| 2004/0035316 | A1 * | 2/2004 | Chebiam et al. | 106/1.22 |
| 2004/0038073 | A1 * | 2/2004 | Chebiam et al. | 428/668 |

FOREIGN PATENT DOCUMENTS

| | | | |
|---|---|---|---|
| EP | 1022770 | A3 | 7/2000 |
| JP | 62-270778 | | 11/1987 |
| JP | 11-288940 | | 7/2000 |
| WO | PCT/US 01/44791 | | 11/2001 |
| WO | PCT/US03/12967 | | 4/2003 |
| WO | WO 03/094209 | | 11/2003 |

OTHER PUBLICATIONS

"Encapsulated Copper Interconnection Devices Using Sidewalls Barriers", Donald S. Gardner et al.; VMIC Conference; Jun. 11-12, 1991, pp. 99-108.

"Planar Copper-Polymide Back End of the Line Interconnections for ULSI Devices"; B. Luther et al. VMIC Conference; Jun. 8-9, 1993, pp. 15-21.

"Electroless plating of copper at a low pH level", R. Jagannathan et al.: IBM J. Res. Develop. vol. 37. No. 2: Mar. 1993, pp. 117-123.

"Selective Electroless Metal Deposition for Integrated Circuit Fabrication", Chiu H. Ting et al.; J. Electrochem Soc. vol. 136, No. 2; Feb. 1989, pp. 456-461. The Electrochemical Society, Inc.

"Selective Electroless Metal Deposition for Via Hole Filling in VLSI Mulitlevel Interconnection Structures"; Chiu H. Ting et al.; J. Electrochem Soc. vol. 136, No. 2; Feb. 1989, pp. 462-465. © The Electrochemical Society, Inc.

"Pd/Si plasma immersion ion implantation for selective elctroless copper plating on $SiO_2$"; Kiang et al.; Applied Phys. Lett. 60 (22): Jun. 1, 1992, pp. 2767-2769. The American Institute of Physics.

"Selective electroless Ni deposition on a TiW underlayer for integrated circuit fabrication"; V.M. Dubin et al.; Thin Solid Films, 226 (1993), pp. 87-93, no month.

"Copper Corrosion With and Without Inhibitors"; V. Brusic et al.; J. Electrochem. Soc. vol. 138, No. 8, Aug. 1991, pp. 2253-2259. © The Electrochemical Society, Inc.

"100 nm wide copper lines made by selective electroless deposition"; Yosi Shacham-Diamand; J. Micromech. Microeng. 1 (1991). pp. 66-732, no month.

"A Half-Micron Pitch Cu Interconnection Technology"; Kazuyoshi Ueno et al.; 1995 Symposium on VSLI Technology Digest of Technical Papers. pp. 27-28, no month.

"Electroless Metal Deposition From Aqueous Solutions", V.V. Sviridov; Minsk Bielorussion State University; 1987. pp. 60-85, no month.

"Passivation of Copper by Silicide Formation In Dilute Silane", S. Hymes, et al. Conf. Proc. USLI-VII, Materials Research Society ; 1992, pp. 425-431, no month.

"Copper Interconnection with Tungsten Cladding for ULSI"; J.S.H. Cho et al.; ULSI Tech. Symp; 1991; pp. 39-40, no month.

C.J. Sambucetti et al. Electroless Depostion of Thin Alloy Layers for Metal Passivation and Solder Barriers. Aug. 31, 1997, Electromechanical Society Proceedings, vol. 97-27, pp. 336-345, XP001058382.

S.D. Lopatin et al., "Thin Elctroless Barrier for Copper Films", Proceedings of thje SPIE, SPIE Bellingham, VA, vol. 3508, Sep. 23, 1998, pp. 65-77, XP001058166.

H. Honma and M. Noguchi, "Electroless Cobalt Bath-Life Extension" Dec. 1990. pp. 67-70.

"Electroless Cu for VLSI"; James S.H. Cho et al.; MRS Bulletin/ Jun. 1993, pp. 31-38.

"Electroless Copper Deposition on Metals and Metal Silicides";Cecilia Y. Mak; MRS Bulletin/ Aug. 1994, pp. 55-62.

"Selective and Blanket Electroless Cu Plating Initiated By Contact Displacement For Deep Submicron Via Contact Filling"; Dubin et al.; VMIC Conf.; Jun. 27-29, 1995, pp. 315-321.

"0.35 um Cu-Filled Via Holes By Blanket Deposited Electroless Copper On Sputtered Seed Layer"; Yosi Shacham-Diamond et al.; VMIC Conf. ; Jun. 27-29, 1995, pp. 334-336.

"Barriers Against Copper Diffusion into Silicon and Drift Through Silicon Dioxide"; Shi-Qing Wang; MRS Bulletin/ Aug. 1994, pp. 30-40.

"Inlaid Copper Multilevel Interconnections Using Planarization by Chemical-Mechanical Polishing"; S.P. Murarka et al.; MRS Bulletin/Jun. 1993, pp. 46-51.

"Electrochemically Deposited Diffusion Barriers"; M. Paunovic; et al. J. Electrochem, Soc., vol. 141, No. 7; Jul. 1994, pp. 1843-1850. © The Electrochemical Society, Inc.

"Electroless Copper Deposition For Multilevel Metallization"; S.Simon Wong et al.; Mat. Res. Soc. Symp. Proc. vol. 203; 1991 Materials Research Society, pp. 347-356. no month.

Watanabe and Honman, "Direct Elctroless Nickel Plating on Copper Circuits Using DMAB as a Second Reducing Agent" IEMT/IMC Proceedings; pp. 149-153 (1998), no month.

T. Osaka et al., "Preparation of CoB Soft Magnetic Thin Films by Electroless Plating" IEEE Translation Journal on Magnetics in JAPAN, vol. 6, No. 1, Jan. 1991. pp. 85-90.

V.M. Dubin, "Selective electroless Ni depositon onto Pd-activated Si for integrated circuit fabrication", Thin Solid Films, 226 (1993) pp. 94-98, no month.

Palmans, et al., "Development of an Electroless Copper Deposition Bath for Via Fill Application on TIN Seed Layers", Conf. Proc. ULSII-X, Materials Research Society, 1995, pp. 87-94, no month available.

* cited by examiner

PREPARATION OF ELECTROLESS DEPOSITION SOLUTIONS

BACKGROUND

1. Field

An embodiment of the invention relates to a solution for use in an electroless deposition process and to methods of preparing and using the solution.

2. Background Information

Electroless deposition processes are widely used to deposit metals on surfaces. In an electroless deposition process a substrate or workpiece object having a surface to be coated may be introduced into a bath containing an electroless deposition solution. The solution often contains a soluble metal salt and a reducing agent, and may contain other chemical additives, such as complexing agents, buffers, bath stabilizers, and rate promoters.

Once introduced into the bath, metal is deposited on the surface based on an electroless deposition process. In a representative electroless deposition process an oxidation-reduction (redox) reaction occurs in which an oxidation number of metal ions of the metal salt are reduced while an oxidation number of the reducing agent is increased. The reaction often proceeds as an autocatalytic, or continuing by itself, chemical reduction at catalytically active sites of the surface. The reaction generally converts the metal ions into a non-ionic metallic state deposited on the surface.

Potential advantages of such an electroless deposition process include uniform layer thickness and ability to deposit metal layers on irregular shaped objects including in holes, recesses, narrow trenches, and other high aspect ratio structures. For these and other reasons, electroless depositions are used widely in industry to form interconnect structures for microelectronic devices, reflective layers for mirrors, metallic coatings for micro-electromechanical devices (MEMS), and more generally to provide metallic layers for workpiece objects such as manufactured parts.

BRIEF DESCRIPTION OF THE SEVERAL VIEWS OF THE DRAWINGS

The invention may best be understood by referring to the following description and accompanying drawings that are used to illustrate embodiments of the invention. In the drawings.

DETAILED DESCRIPTION

Disclosed herein are solutions for use in an electroless deposition process, and methods for preparing and using the solutions. In the following description, numerous specific details are set forth. However, it is understood that embodiments of the invention may be practiced without these specific details. In other instances, well-known circuits, structures and techniques have not been shown in detail in order not to obscure the understanding of this description.

I. Introduction

The inventors have discovered that the characteristics and quality of an electroless deposition solution may change or degrade over time. The color of the solution may change significantly over a period of time ranging from several days to a week. Miniature particles may form in the solutions over the same time period. Without wishing to be bound by theory it is believed that the changes are a result of complex-formation reactions that occur in the solutions. In any event, the gradual and uncontrolled change of an electroless deposition solution is generally undesirable. It is not surprising that in precision applications, such as forming interconnect structures in microelectronic devices, uncontrolled changes in the solution chemistry and characteristic may be problematic. The characteristics of the electroless deposition process may have a significant impact on the operation of the electroless deposition process, and ultimately on the final product, and changes in the solution characteristics are generally undesirable. In the case of forming interconnect structures, particles are generally to be avoided. In some cases the solution may change so much that it becomes unusable and needs to be disposed of, potentially as a regulated hazardous material. This may increase the overall cost of performing the deposition.

II. Preparing and Using Electroless Deposition Solutions

Figure 1:
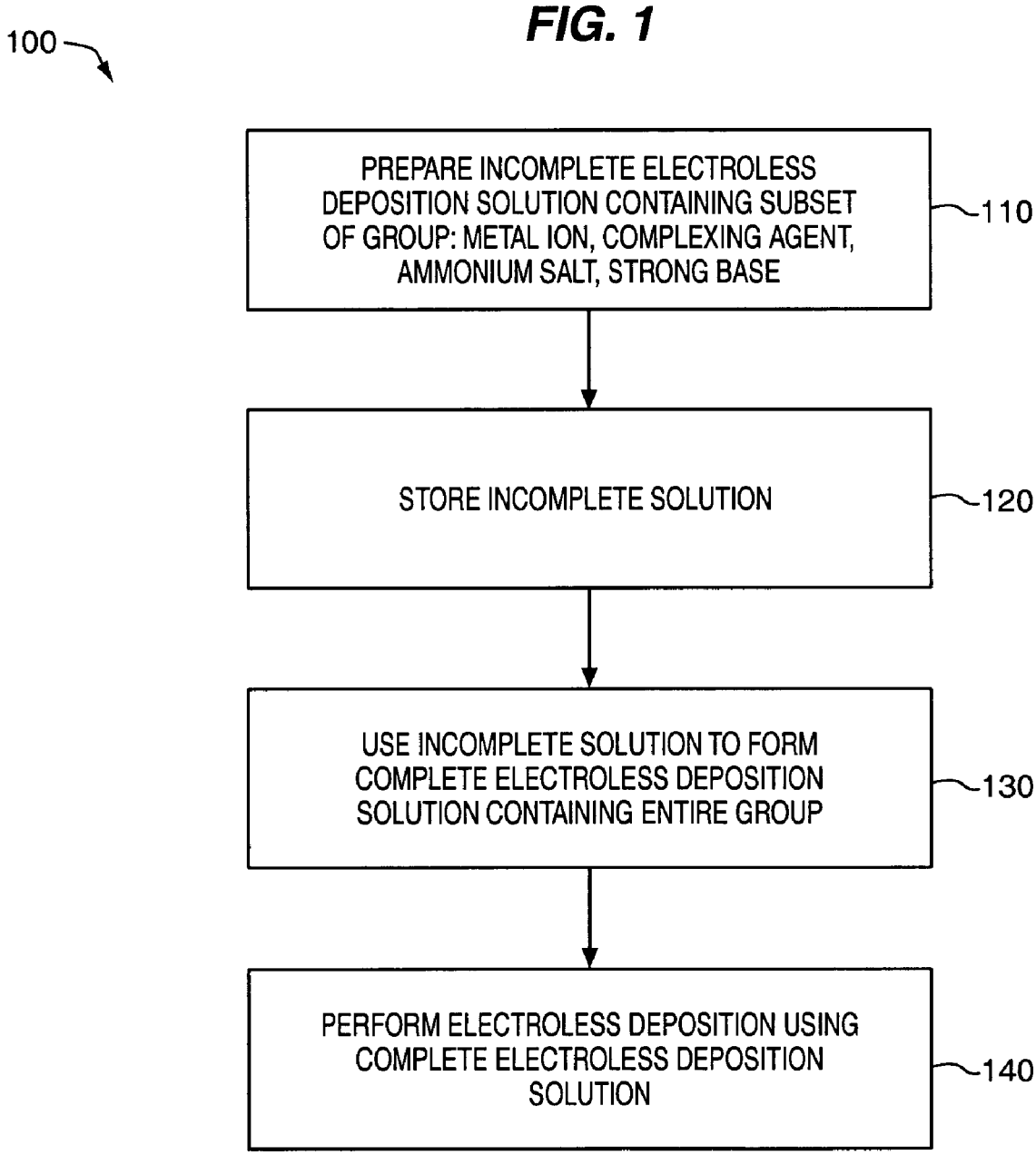
FIG. 1 is a flow diagram of a method for preparing an electroless deposition solution and using the solution to perform an electroless deposition, according to one embodiment of the invention.

FIG. 1 is a flow diagram of a method 100 for preparing and using an electroless deposition solution, according to one embodiment of the invention. The method includes preparing at least one or a plurality of incomplete electroless deposition solutions, each containing a subset of a group consisting of a metal ion, a complexing agent, an ammonium salt, and a strong base, at block 110. The incomplete electroless deposition solution or solutions omit at least one component of the group. Next, the incomplete electroless deposition solution is stored, at block 120. The solution may be stored for a period of time in a range between approximately 2 to 60 days, or longer. Then, often nearer to an intended time of use in an electroless deposition, the incomplete electroless deposition solution is used to form a complete electroless deposition solution that contains the entire group, at block 130. The at least one omitted component, and typically a reducing agent may be introduced into the incomplete electroless deposition solution. Next, the completed electroless deposition solution is used to perform an electroless deposition, at block 140.

The inventors have discovered that preparing the incomplete electroless deposition solution may help to stop, or at least slow, transformations or reactions that would otherwise occur in a solution containing the entire group. Again, without wishing to be bound by theory, it is believed that complex-formation reactions may occur in a solution containing the entire group (the metal ion, the complexing agent, the ammonium salt, and the strong base). Experiments by the inventors indicate that omitting one or more of the components of the group may help to stop, or at least slow, the complex-formation reactions. Complete omission is not required. Trace amounts, or even amounts about 1 up to about 10% of the final amount may be tolerated, although some increased level of transformation may be expected.

Then, nearer to an intended time of use of the electroless deposition solution, the omitted component may be introduced into the at least one prepared incomplete electroless deposition solution. In this way the completion of the group in a single solution is delayed, relative to formation of the initial incomplete electroless deposition solution. Such approaches may be used advantageously to increase the stability and shelf life of electroless deposition solutions, so that they may be stored for prolonged periods, while maintaining consistent operational characteristics.

Referring again to FIG. 1, in preparing the incomplete electroless deposition solution, suitable metal ions include but are not limited to transition metal ions, such as cobalt ions, nickel ions, and iron ions, and refractory metal ions, such as tungsten ions, molybdenum ions, niobium ions, and tantalum ions. As is known, metals are often alloyed by electroless deposition to improve thermal and other characteristics. Accordingly mixtures or combinations of metal ions may also optionally be employed to form electrolessly deposited alloys, such as cobalt-tungsten (CoW) alloys, nickel-tungsten (NiW) alloys, or other alloys. The metal ions may be introduced into the solution by adding a metal-containing compound, such as a metal salt. Exemplary metal salts include, but are not limited to, salts of cobalt, such as cobalt chloride (e.g., $CoCl_2.6H_2O$) or cobalt sulfate, salts of nickel, such as nickel chloride, salts of tungsten, salts of rhenium, and other salts that are well-known in the arts. The metal salts may be added in an amount that is sufficient to give a concentration of metal ions that is in a range between approximately 0.05–0.5 mol/L or between approximately 0.1–0.2 mol/L. The invention is not limited to these particular concentrations. Virtually any concentration employed in conventional electroless deposition solutions may be suitable.

Complexing agents that are suitable for such metal ions include, but are not limited to, carboxylic acids, ethylenediamine, glycine, EDTA, and combinations thereof. Exemplary carboxylic acids that are suitable include, but are not limited to, citric acid, malonic acid, succinic acid, propionic acid, and acetic acid. The complexing agent may be employed at a concentration in a range between approximately 0.1–0.6 mol/L or between approximately 0.3 to 0.4 mol/L. Alternatively, virtually any other concentration conventionally employed in electroless deposition solutions may be used.

Ammonium salts are often employed in the electroless deposition solution as alkaline metal free weak acid agents to adjust or buffer the solution pH. Suitable ammonium salts include, but are not limited to, ammonium halides, ammonium carboxylates, ammonium sulfates, and combinations thereof. Exemplary ammonium halides include, but are not limited to, ammonium fluoride ($NH_4F$), ammonium chloride ($NH_4Cl$), ammonium bromide ($NH_4Br$), ammonium iodide ($NH_4I$), and alkylammonium halides. Exemplary alkylammonium halides include, but are not limited to, tetraalkylammonium halides, such as tetramethylammonium chloride ($(CH_3)_4NCl$), and other polyalkylammonium halides. Lower alkyl groups with between 1 to 2 or 1 to 4 carbon atoms may be appropriate. Exemplary ammonium carboxylates include, but are not limited to, ammonium citrate, ammonium malonate, ammonium succinate, ammonium propionate, ammonium acetate, and alkylammonium carboxylates. Exemplary alkylammonium carboxylates include, but are not limited to, tetralkylammonium carboxylates, such as tetramethylammonium citrate; and other polyalkylammonium carboxylates. Exemplary ammonium sulfates include, but are not limited to, ammonium sulfate ($(NH_4)_2SO_4$) and alkylammonium sulfates, such as tetramethylammonium sulfate, or other polyalkylammonium sulfates. The ammonium salt may be employed at a concentration in a range between approximately 0.5 to 1.5 mol/L or between approximately 0.9 to 1.1 mol/L. Alternatively virtually any other concentration conventionally employed in electroless deposition solutions may be used.

Strong bases that are suitable as pH adjusters include, but are not limited to, alkaline metal free hydroxides, such as alkylammonium hydroxides, as well as alkaline metal hydroxides, such as sodium hydroxide (NaOH) and potassium hydroxide (KOH), and combinations thereof. Suitable alkylammonium hydroxides include tetraalkylammonium hydroxides and other polyalkylammonium hydroxides. Exemplary tetralkylammonium hydroxides include, but are not limited to, tetramethylammonium hydroxide (TMAH, $(CH_3)_4NOH$), tetraethylammonium hydroxide (TEAH), tetrapropylammonium hydroxide (TPAH), and tetrabutylammonium hydroxide (TBAH). The use of lower alkyl groups having a number of carbon atoms in a range between 1 to 2 or 1 to 4 may be appropriate. The strong bases may be employed in amounts that are sufficient to adjust a pH of the electroless deposition solution to an appropriate value. Some electroless depositions are performed under acidic conditions (pH<7) whereas others are performed under alkaline or basic conditions (pH>7). Depending upon the particular electroless deposition the strong base may be added in an amount sufficient to adjust the pH of the electroless deposition solution to a value in a range of about 3 to 14, about 7 to 12, about 9 to 11, or about 10.

Other chemical additives may optionally be employed in the incomplete electroless deposition solution. Exemplary chemical additives include, but are not limited to, bath stabilizers, rate promoters, surfactants, and the like. These components, if desired, may be employed at conventional concentrations.

According to one embodiment of the invention, preparing the incomplete electroless deposition solution, at block 110, may include preparing a solution containing a metal ion, a complexing agent, an ammonium salt, potentially other chemical additives, and omitting a strong base

EXAMPLE 1

This example demonstrates how to prepare an incomplete electroless deposition solution containing a metal ion, a complexing agent for the metal ion, an ammonium salt, and omitting a strong base, according to one embodiment of the invention. Approximately 60 to 80 grams of anhydrous citric acid ($C_6H_8O_7$) were added to approximately one-half liter of water to form a citric acid solution. Then approximately 30 to 40 grams of hexahydrate cobalt chloride ($CoCl_2.6H_2O$) crystals were added to the resultant citric acid solution. The hydrated cobalt chloride was dissolved to form cobalt ions. Usually concurrently with the dissolution the citric acid begins to complex the cobalt ions to help maintain them in solution. Next approximately 50 to 60 grams of solid ammonium chloride ($NH_4Cl$) crystals were added to the resultant metal ion containing solution and dissolved. The invention is not limited to these particular concentrations and virtually any concentration employed in conventional electroless deposition solutions may be suitable. The above-identified starting materials are commercially available from numerous sources, including from Sigma-Aldrich Co. of St. Louis, Mo. Notice that a strong base such as tetramethylammonium hydroxide (TMAH) was intentionally omitted from the incomplete electroless deposition solution of this example. It is to be understood that this example is merely illustrative.

According to another embodiment of the invention, preparing the incomplete electroless deposition solution at block 110 may include preparing a solution containing a metal ion, a complexing agent, a strong base, and potentially other chemical additives, and omitting an ammonium salt.

EXAMPLE 2

This example demonstrates how to prepare a solution containing a metal ion, a complexing agent, a strong base, and omitting an ammonium salt, according to one embodiment of the invention. Approximately 60 to 80 grams of anhydrous citric acid ($C_6H_8O_7$) were added to approximately one-half liter of water to form a citric acid solution. Then approximately 30 to 40 grams of hexahydrate cobalt chloride ($CoCl_2.6H_2O$) crystals were added to the resultant citric acid solution. The hydrated cobalt chloride was dissolved to form cobalt ions. Usually concurrently with the dissolution the citric acid begins to complex the cobalt ions to help maintain them in solution. A sufficient amount of a 25 wt % solution of tetramethylammonium hydroxide (TMAH) in water was added to the first solution to give a pH in a range between approximately 7 to 12, or about 9–11, or about 10. Such solutions are commercially available and also may be prepared by introducing, for example dissolving, an appropriate proportion of solid pentahydrate tetramethylammonium hydroxide in a corresponding proportion of water. This particular concentration is not required but for this solution the inventors added between 300 to 500 ml/L of the 25 wt % TMAH solution slowly until the resultant solution achieved the desired pH. The invention is not limited to these particular concentrations and virtually any concentration employed in conventional electroless deposition solutions may be suitable. The above-identified starting materials are commercially available from numerous sources, including from Sigma-Aldrich Co. of St. Louis, Mo. Notice that an ammonium salt such as ammonium chloride was intentionally omitted from the incomplete electroless deposition solution of this example. It is to be understood that this example is merely illustrative.

According to yet another embodiment of the invention, preparing the incomplete electroless deposition solution at block 110 may include preparing a solution containing a strong base and an ammonium salt and omitting a metal ion and a complexing agent for the metal ion. Other embodiments are contemplated.

Such preparation of an incomplete electroless deposition solution, omitting one or more components of the group consisting of the metal ion, the complexing agent, the ammonium salt, and the strong base, may help to stop, or at least slow, reactions or other transformations that would occur in a solution containing the entire group. The inventors contemplate that such approaches may be used advantageously to increase the stability and shelf life of electroless deposition solutions so that they may be stored for prolonged periods while maintaining consistent operational characteristics.

Referring again to FIG. 1, the at least one incomplete electroless deposition solution may be stored for a period of time up to, or in a range between, approximately 2 to 60 days, or longer, at block 120. Since the stored solution contains only a subset of the group, and omits at least one group component, the inventors have found that chemical transformations of the solution during the storage period is stopped, or at least significantly slowed, relative to chemical transformations that would occur in a solution containing the entire group (omitting no group components). As a result, the solution may be stored for longer periods of time with relatively less changes, for example in terms of redox characteristics, color change, and particle formation, than would be expected for storage of a solution containing the entire group.

The ability to store a solution may offer a number of potential advantages. On the one hand, relatively large quantities of a solution may be prepared for efficiency. These solutions may be stored and then subsequently used in smaller portions as needed by the electroless deposition process. On the other hand, the solution preparation may be sourced to another entity, such as a bulk chemical supplier. An ability to store the solution over such periods of time without inappropriate amounts of transformation also may facilitate inventory maintenance and avoid a potentially costly process shutdown due to running out of solution or excessively transformed solution. Accordingly the inventors contemplate that the systems and methods disclosed herein may greatly advance the state of the electroless deposition arts.

Then, nearer to an intended time of use of the electroless deposition solution, the omitted component may be introduced into the at least one prepared incomplete electroless deposition solution. Referring again to FIG. 1, after the desired storage period, the incomplete electroless deposition solution may be used to form a complete electroless deposition solution, at block 130. Generally within about 1 minute to 1 hour prior to an intended time of use of the electroless deposition solution in a deposition process, the electroless deposition solution maybe provided from storage and the one or more omitted group components maybe introduced into the incomplete solution. Often one or more solutions collectively containing the one or more omitted components may be combined with the incomplete electroless deposition solution, although this is not required, and solid or other forms of the omitted components may optionally be employed. As one example, if the incomplete electroless deposition solution omits the strong base, then a solution containing the strong base may be combined with the incomplete electroless deposition solution. Alternatively, as another example, if the incomplete electroless deposition solution omits the ammonium salt, then crystals of an ammonium salt, such as ammonium chloride, may be dissolved in the incomplete electroless deposition solution. In this way the completion of the group in a single solution is delayed relative to formation of the initial incomplete electroless deposition solution. The resultant solution containing the entire group is sometimes referred to in the arts as an electroless electrolyte solution.

EXAMPLE 3

This example demonstrates how to use the solution of Example 1 to form an electroless deposition solution containing a complete group of components, according to one embodiment of the invention. After storing the solution of Example 1 for any desired period of time, such as a period between 2 to 60 days, or longer, tetramethylammonium hydroxide is introduced into the first solution. A sufficient amount of a 25 wt % solution of tetramethylammonium hydroxide (TMAH) in water was added to the first solution to give a pH in a range between approximately 7 to 12, or about 9–11, or about 10. Such solutions are commercially available and also may be prepared by introducing, for example dissolving, an appropriate proportion of solid pentahydrate tetramethylammonium hydroxide in a corresponding proportion of water. This particular concentration is not required but for this solution the inventors added between 300 to 500 ml/L of the 25 wt % TMAH solution slowly until the resultant solution achieved the desired pH. The resultant completed electroless electrolyte solution has a metal ion concentration in a range of approximately 0.1 to 0.15 mol/L, a citric acid concentration in a range of approximately 0.3 to 0.4 mol/L, an ammonium chloride concentration in a range of approximately 0.9 to 1.1 mol/L, and a pH in a range of approximately 9 to 11. It is to be understood that this example is merely illustrative.

EXAMPLE 4

This example demonstrates how to use the solution of Example 2 to form an electroless deposition solution containing a complete group, according to one embodiment of the invention. After storing the solution of Example 2 for any desired period of time, such as a period between 2 to 60 days, or longer, an ammonium salt was introduced into the solution of Example 2. Approximately 50 to 60 grams of solid ammonium chloride ($NH_4Cl$) crystals were added to the resultant metal ion containing solution and dissolved. This particular amount is not required. A weak aqueous solution of the ammonium chloride may alternatively be employed. The resultant completed electroless electrolyte solution has a metal ion concentration in a range of approximately 0.1 to 0.15 mol/L, a citric acid concentration in a range of approximately 0.3 to 0.4 mol/L, an ammonium chloride concentration in a range of approximately 0.9 to 1.1 mol/L, and a pH in a range of approximately 9 to 11. It is to be understood that this example is merely illustrative.

A reducing agent is generally added to the electrolyte solution to complete the formation of the electroless deposition solution. The addition of the reducing agent is often timed to coincide closely with the actual time of use of the solution, in order to avoid significant chemical reaction prior to use in the deposition process. The introduction of the reducing agent may be substantially simultaneous with the addition of the one or more omitted components, or may slightly lag the introduction of the one or more omitted components. Exemplary reducing agents used commonly in the electroless deposition arts include, but are not limited to, dimethylamine borane (DMAB), borohydride, hypophosphite, glyoxylic acid, formaldehyde, and combinations thereof.

Referring again to FIG. 1, the completed electroless deposition solution containing the entire group, and the reducing agent, may be used to perform an electroless deposition. The completed electroless deposition solution may be introduced into a bath. Then a substrate or workpiece object, such as a substrate having an interconnect trench or via, having one or more surfaces to be coated, may be introduced into the bath. Once introduced into the bath, metal maybe deposited on the surface based on an electroless deposition process. In a representative electroless deposition process, an oxidation-reduction (redox) reaction occurs in which an oxidation number of metal ions of the metal salt are reduced while an oxidation number of the reducing agent is increased. The reaction often proceeds as an autocatalytic, or continuing by itself, chemical reduction at catalytically active sites of the surface. The reaction generally converts the metal ions into a non-ionic metallic state deposited on the surface.

In one embodiment of the invention the electroless deposition process is used to form at least a portion of an interconnect structure for a microelectronic device, such as an interconnect line filling an interconnect trench, or a via filling a window. Microelectronic devices, in one embodiment microprocessors, containing the interconnect structures may be incorporated in various forms electrical systems including computer systems (e.g., portable, laptop, desktop, server, mainframe, etc.). As is known such a computer system may include a microprocessor to process data, a bus to communicate data, a main memory to store data, a read only memory to store data, a mass storage device to store data, a display device to display data, a keyboard to enter data, a cursor control device to enter data, and a communication device to link to other electrical systems. Optional components employed in some computer systems—but not all computer systems—include DRAM memory or SRAM memory, graphics controllers, video cards, transceivers, and the like.

III. System to Prepare Electroless Deposition Solutions

Figure 2:
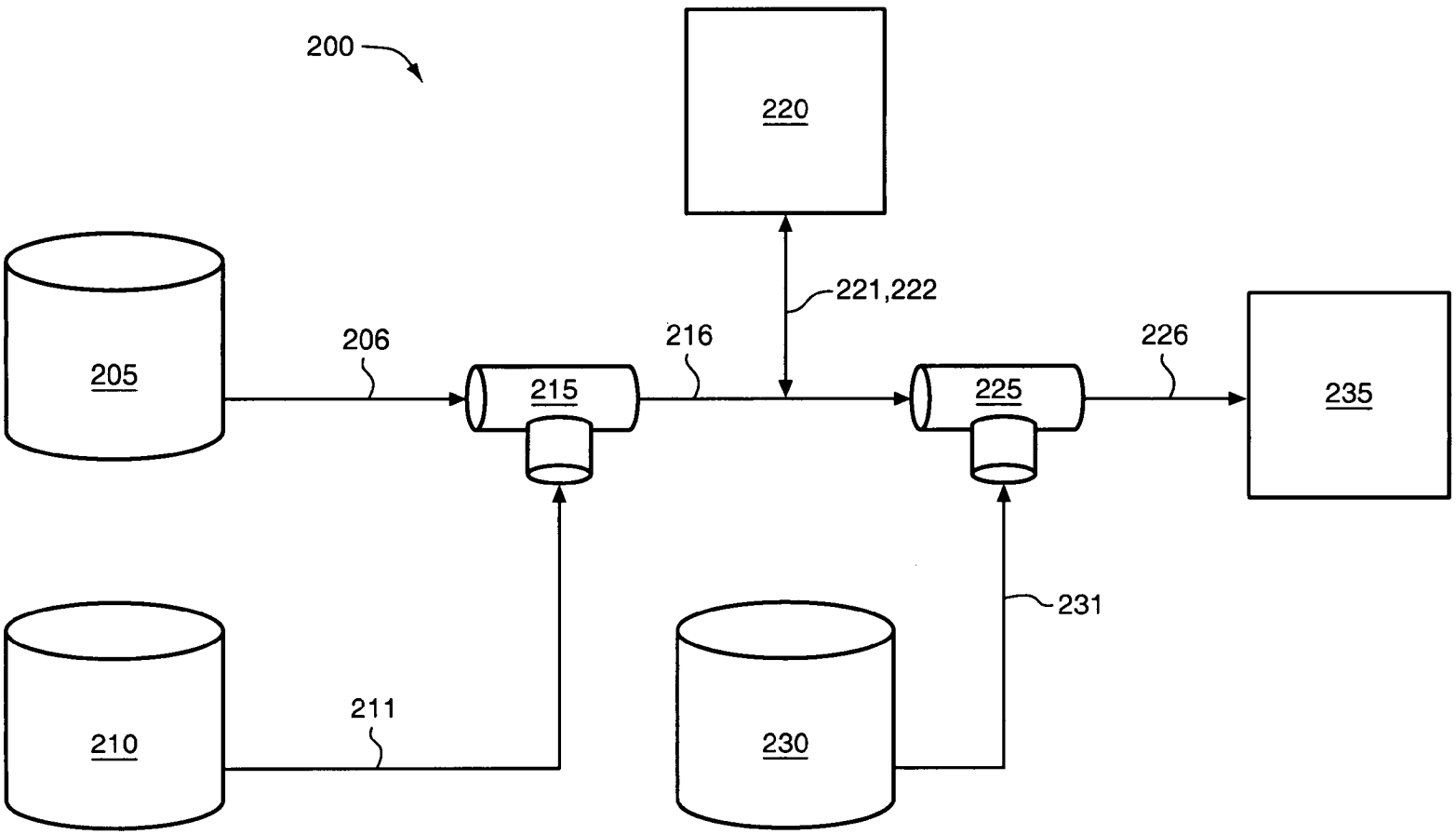
FIG. 2 is a block diagram of a system for preparing an electroless deposition solution, according to one embodiment of the invention.

FIG. 2 is a block diagram of a system 200 to prepare an electroless deposition solution for use in an electroless deposition process, according to one embodiment of the invention. The system includes a source 205 to contain, store, and provide an incomplete electroless deposition solution. The source of the incomplete solution may include a vessel, such as a tank, drum, or cylinder. In one example, the source may contain a solution containing a metal ion, a complexing agent, an ammonium salt, potentially other chemical additives, and omitting a strong base. The source may store a quantity of the incomplete electroless deposition solution for a period of time up to or between approximately 2 to 60 days, or longer. In one aspect the quantity of the solution may be received from a bulk chemical supplier and stored. Then, nearer to an intended time of use of the electroless deposition solution in an electroless deposition process 235, usually between a minute to an hour before such use, at least a portion of the incomplete electroless deposition solution may be provided from its source to a fluid combining device, such as a component introduction tee 215, via an incomplete electroless deposition solution supply line 206. Other suitable fluid combining devices include other manifolds, vessels, stored tanks, inline mixers and the like. Gravity flow, a pump, or another fluid conveyance device may be used to provide the solution from the first source to the component introduction tee.

The system also includes a source 210 to contain, potentially store, and provide one or more group components that are omitted from the incomplete electroless deposition solution. In the illustrated embodiment, the components may be provided by way of a solution to facilitate metering and conveyance, although this is not required, and alternatively the components may be in solid or other form. In one example, the source of the one or more omitted components may contain a solution of a strong base. Often, the source may store the solution of the omitted component for a period of time up to or between approximately 2 to 60 days, or longer. Then, often at a time proximate to when the incomplete electroless deposition solution is provided from the source, such as within a few seconds, an appropriate corresponding proportion of the solution containing the one or more omitted components may be provided from the source to the component introduction tee 215 via a component supply line 211.

The component introduction tee 215 is coupled with both the sources via the intervening supply lines and serves as a fluid combining device to combine the introduced fluids. The tee receives the incomplete electroless deposition solution and the solution containing the one or more omitted components, combines them, often mixes them, and provides them through an outlet opening thereof an electroless electrolyte solution supply line 216.

An optional analysis system 220, such as a spectrometer, is shown in the illustrated system, may exchange interrogation 221 and interrogation result signals 222 with the solution in the electroless electrolyte solution supply line. The analysis may measure a quantity that is expected to change over time in the solution, such as color, particle content, or spectroscopic absorption at a particular wavelength. This analysis may be used to assess and verify suitability of the solution and facilitate quality control.

The solution in the electroless electrolyte solution supply line may be provided to a second fluid combination device, such as a reducing agent introduction tee 225. Then, often at a time proximate to the providing of this solution, a reducing agent or solution thereof 230 may be provided to the reducing agent introduction tee via a reducing agent supply line 231. The second tee may combine the solutions and often mix them. Then the tee may provide the resultant completed electroless deposition solution to the electroless deposition process 235, via an intervening electroless deposition solution supply line 226.

Experimental Results

Figure 3:
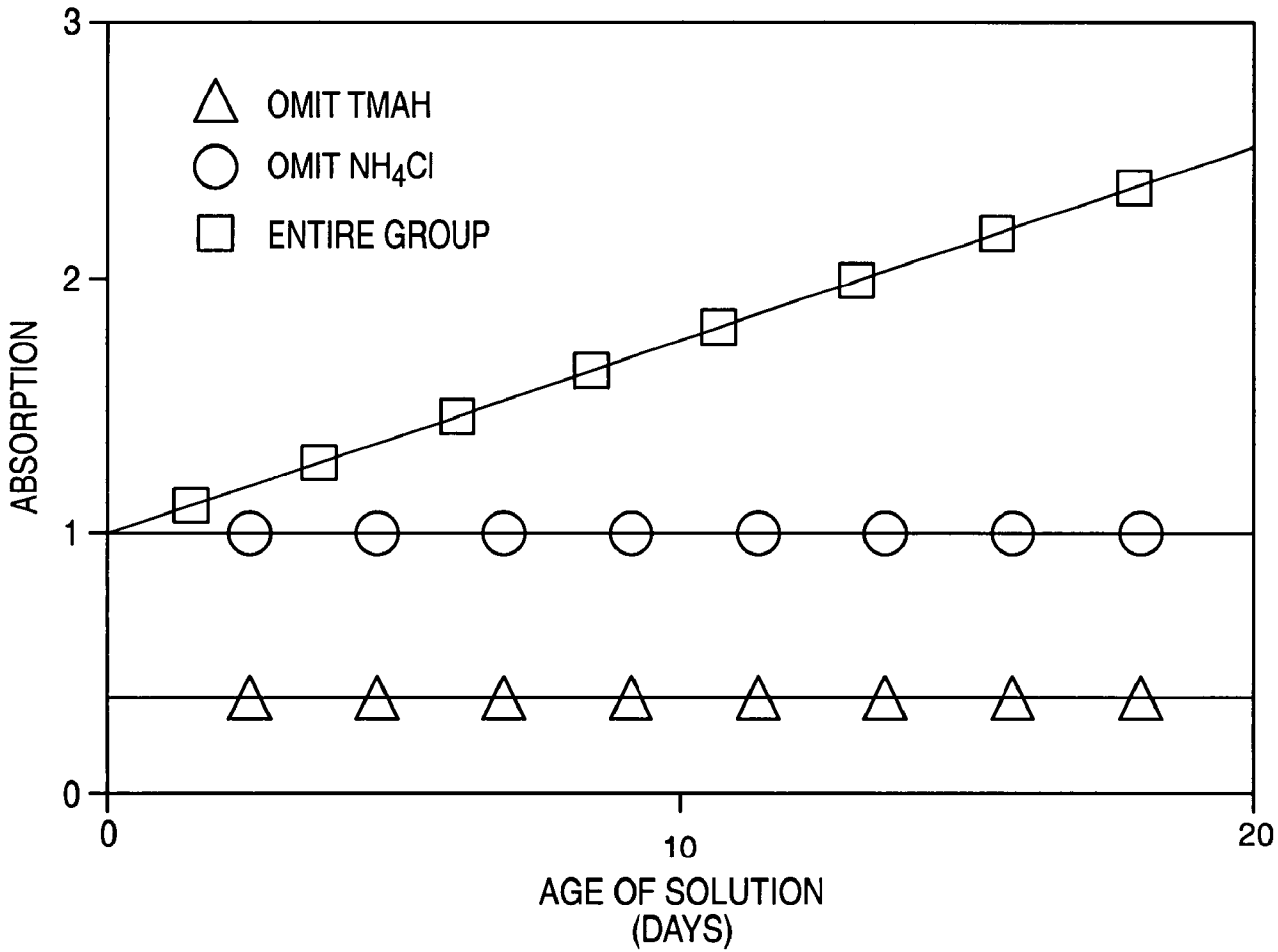
FIG. 3 is a plot of spectroscopic absorption data for an electroless deposition solution versus solution age, according to one embodiment of the invention.

FIG. 3 is a plot of spectroscopic absorption data for three electroless electrolyte solutions on the y-axis versus age of the solutions in days on the x-axis, according to one embodiment of the invention. A first solution was prepared as described in Example 1 and contains a subset omitting tetramethylammonium hydroxide (TMAH). A second solution was prepared as described in Example 2 and contains a subset omitting ammonium chloride ($NH_4Cl$). A third solution was prepared similar to the first solution, except that instead of omitting TMAH, a sufficient amount of TMAH was included to adjust the pH to approximately 10. Accordingly the third solution contains the entire group.

Spectroscopic absorptions for the first, second, and third solutions are indicated by the lines marked respectively with open triangles (Δ), open circles (○), and open squares (□). The absorption data reflect maximum absorptions for the three solutions measured with an ultraviolet-visible spectrometer at a wavelength in the range of approximately 510–530 nanometers (nm). At day zero the absorption for the first solution was approximately 0.4 and for the second and third solutions was approximately 1. The difference is due to difference in compositions.

Over the twenty-day period, the absorption for the first and the second solutions remained substantially constant, whereas the absorption of the third solution changed significantly. As shown, the lines representing absorption for the first (Δ) and the second solutions (○) remained substantially flat, or horizontal, indicating a substantially invariant absorption behavior. The substantial constancy in the absorptions of the second and the third solutions indicates reduced chemical reactions and relative chemical stability. These experiments indicate that the incomplete electroless deposition solutions of Examples 1 and 2 may be stored for up to a month, or longer, with almost no change in color, particle content, or spectroscopic absorption.

In contrast, the line representing the third solution (■) steadily increased in y-value from an initial value of approximately 1 to a final value on day twenty of approximately 2.5. This significant increase in the absorption—about 250%—is indicative of significant transformation of the solution due to chemical reactions. Over the twenty-day period the color of the third solution changed and minute particles formed. No such color change or particle formation was observed in the first and second solutions. These experimental results are believed to indicate relative chemical stability in the first and second solutions, according to an embodiment of the invention, compared to the third solution.

In the description above, for the purposes of explanation, numerous specific details are set forth in order to provide a thorough understanding of the present invention. It will be apparent, however, to one skilled in the art that the present invention can be practiced without some of these specific details. In other instances, well-known structures, devices, and techniques have been shown in block diagram form or without detail in order not to obscure the understanding of this description Many of the methods are described in their most basic form, but operations can be added to or deleted from any of the methods. It will be apparent to those skilled in the art that many further modifications and adaptations can be made. The particular embodiments are not provided to limit the invention but to illustrate it. The scope of the present invention is not to be determined by the specific examples provided above but only by the claims below.

It should also be appreciated that reference throughout this specification to "one embodiment" or "an embodiment" means that a particular feature can be included in the practice of the invention. Similarly, it should be appreciated that in the foregoing description of exemplary embodiments of the invention, various features of the invention are sometimes grouped together in a single embodiment, Figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

What is claimed is:

1. A method comprising:

storing for at least two days a solution containing a subset of a group consisting of a metal ion, a complexing agent, an ammonium salt, and a strong base, wherein the subset includes at least two components of the group; and nearer to a time of use in an electroless deposition process, using the solution to form a second electroless deposition solution containing the entire group.

2. The method of claim 1:

wherein the subset includes the ammonium salt and lacks the strong base; and wherein said using includes introducing the strong base into the solution that was stored.

3. The method of claim 1:

wherein the subset includes the strong base and lacks the ammonium salt; and wherein said using includes introducing the ammonium salt into the solution that was stored.

4. The method of claim 1:

wherein the metal ion includes a metal ion that is selected from the group consisting of a cobalt ion, a nickel ion, an iron ion, a tungsten ion, a molybdenum ion, a niobium ion, a tantalum ion, and combinations thereof;

wherein the complexing agent includes one or more carboxylic acids;

wherein the ammonium salt includes an ammonium salt that is selected from the group consisting of an ammonium halide, an ammonium carboxylate, an ammonium sulfate, and combinations thereof; and wherein the strong base includes a base that is selected from the group consisting of a tetralkylammonium hydroxide, sodium hydroxide, and potassium hydroxide.

5. The method of claim 4:

wherein the subset includes the ammonium salt and lacks the strong base; and wherein said using includes introducing the strong base into the stored solution.

6. The method of claim 4:

wherein the subset includes the strong base and lacks the ammonium salt; and wherein said using includes introducing the ammonium salt into the stored solution.

7. The method of claim 4:

wherein the metal ion includes a cobalt ion, the complexing agent includes citric acid, the ammonium salt includes ammonium chloride, and the strong base includes tetramethylammonium hydroxide;

wherein the subset includes the ammonium salt and lacks the strong base; and wherein said using includes introducing the strong base into the solution that was stored.

8. The method of claim 1:

wherein the metal ion includes a cobalt ion, the complexing agent includes citric acid, the ammonium salt includes ammonium chloride, and the strong base includes tetramethylammonium hydroxide;

wherein the subset includes the strong base and lacks the ammonium salt; and wherein said using includes introducing the ammonium salt into the solution that was stored.

9. The method of claim 1, wherein the subset includes at least three components of the group.

10. The method of claim 1, wherein the second electroless deposition solution comprises from 0.05 to 0.5 mol/L of the metal ion, from 0.1 to 0.6 mol/L of the complexing agent, and from 0.5 to 1.5 mol/L of the ammonium salt.

11. The method of claim 1, further comprising:

adding a reducing agent to the second electroless deposition solution; and using the resultant solution to perform an electroless deposition.

12. An electroless deposition solution prepared according to the method of claim 1.

13. An electroless deposition solution prepared according to the method of claim 2.

14. An electroless deposition solution prepared according to the method of claim 3.

15. A method comprising:

storing for at least two days a solution that omits one or two components selected from a group consisting of a metal ion, a complexing agent, an anmmonium salt, and a strong base; and after said storing, combining the one or two omitted components and a reducing agent with the solution to form an electroless deposition solution.

16. The method of claim 15:

wherein the solution that is stored includes the ammonium salt and omits the strong base; and wherein said combining includes combining the strong base with the solution that was stored.

17. The method of claim 15:

wherein the solution that is stored includes the strong base and omits the ammonium salt; and wherein said combining includes combining the ammonium salt with the solution that was stored.

18. A system comprising:

a first source including an incomplete electroless deposition solution, the incomplete electroless deposition solution including a subset of a group consisting of a metal ion, a complexing agent, an ammonium salt, and a strong base and omitting one or two components of the group;

a second source including the one or two omitted components of the group; and a fluid combination device coupled with the first source and the second source to receive the incomplete electroless deposition solution and the one or two omitted components and to introduce the one or two omitted components into the incomplete electroless deposition solution.

19. The system of claim 18, wherein the fluid combination device comprises a tee.

20. The system of claim 18:

wherein the subset lacks the strong base; and wherein the fluid combination device introduces the strong base into the solution that was stored.

21. The system of claim 20, wherein the subset includes the ammonium salt.

22. The system of claim 18:

wherein the subset lacks the ammonium salt; and wherein the fluid combination device introduces the ammonium salt into the solution that was stored.

23. The system of claim 22, wherein the subset includes the strong base.

* * * * *